US006711861B2

(12) United States Patent
Berger, Jr.

(10) Patent No.: US 6,711,861 B2
(45) Date of Patent: Mar. 30, 2004

(54) WINDOW FRAME FOR AN OPENING CLOSURE WITH INTERNAL CHANNEL

(76) Inventor: Allen Berger, Jr., 12195 NW. 98 Ave., Hialeah Gardens, FL (US) 33018

( * ) Notice: Subject to any disclaimer, the term of this patent is extended or adjusted under 35 U.S.C. 154(b) by 0 days.

(21) Appl. No.: 10/277,210

(22) Filed: Oct. 22, 2002

(65) Prior Publication Data

US 2004/0016188 A1 Jan. 29, 2004

Related U.S. Application Data

(63) Continuation-in-part of application No. 10/201,762, filed on Jul. 23, 2002.

(51) Int. Cl.[7] ..... E04B 7/18

(52) U.S. Cl. ..... 52/208; 52/204.55; 52/204.68; 52/204.7

(58) Field of Search ..... 52/208, 204.55, 52/204.57, 204.58, 204.68, 204.7, 800.17, 800.18

(56) References Cited

U.S. PATENT DOCUMENTS 3,382,630 A * 5/1968 Chivers ..... 52/208
3,444,662 A * 5/1969 Partain ..... 52/786.12
4,050,200 A * 9/1977 Beck, Jr. ..... 296/215
4,207,913 A * 6/1980 Fike, Jr. ..... 137/68.23
4,603,531 A * 8/1986 Nash ..... 52/793.1
4,821,909 A * 4/1989 Hibler et al. ..... 220/203.08

OTHER PUBLICATIONS

U.S. patent application Ser. No. 09/885,603, Allen Berger, Jr. filed Jun. 20, 2001.

* cited by examiner

*Primary Examiner*—Carl D. Friedman
*Assistant Examiner*—Basil Katcheves
(74) *Attorney, Agent, or Firm*—J. Sanchelima; A. Bordas

(57) ABSTRACT

A window frame for an opening closure having an outer and an inner frame assembly that sandwich a transparent member and a skin or panel with an opening. The outer and inner frame assemblies include each two vertical frame members are kept at a spaced apart and parallel relationship with respect to each other and two horizontal perpendicularly mounted to the vertical frame members. The outer frame members include longitudinal internal channels with a T-shape cross-section defining a wider innermost portion cavity and a narrower neck portion. The innermost portion slidably receives nuts that cooperate with a fastening member to securely mount the outer frame members, transparent member, panel and inner frame members, with fastening members therethrough. None of the hardware is visible from outside the closure.

6 Claims, 3 Drawing Sheets

WINDOW FRAME FOR AN OPENING CLOSURE WITH INTERNAL CHANNEL

OTHER RELATED APPLICATIONS

The present application is a continuation-in-part pending of U.S. patent application Ser. No. 10/201,762, filed on Jul. 23, 2002, for a window assembly for opening closures, which is hereby incorporated by reference.

BACKGROUND OF THE INVENTION

1. Field of the Invention

The present invention relates to a window frame, and more particularly, to the type that includes an internal channel for receiving security-fastening members.

2. Description of the Related Art

Many designs for window frames have been designed in the past. None of them, however, includes internal channels in the outer frame assemblies for receiving security-fastening members therein.

Applicant believes that the closest reference corresponds to U.S. patent application Ser. No. 09/885,603 filed on Jun. 20, 2001 by the applicant of the present invention for a keyed window assembly for garage doors. The keyed window assembly includes resilient male (30) and female (40) frame members that are brought towards each other to sandwich the borders of the door panel (20) defining the window opening and the cooperatively dimensioned transparent panel (50). The male frame member (30) includes a peripherally extending leg member (31) that is lockingly received within a cooperative channel notch (51) on the transparent panel (50). Fastening members (60) are used to keep the male (30) and female (40) frame members securely against each other. However, it differs from the present invention because the present invention includes inner peripheral surfaces with channels having a T-shape cross-section defining a longitudinal cavity and a neck, the former being wider than the latter. The cavity is intended to slidably receive the nuts when the user cooperatively positions the fastening member through the neck, securing the outer member, the inner frame, the transparent member and the panel.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a reinforced window frame that withstands substantial wind loads and object impacts.

It is another object of this invention to provide a burglar resistant window frame.

It is still another object of the present invention to provide a window frame that can be readily installed in a panel opening.

It is yet another object of this invention to provide such a window assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
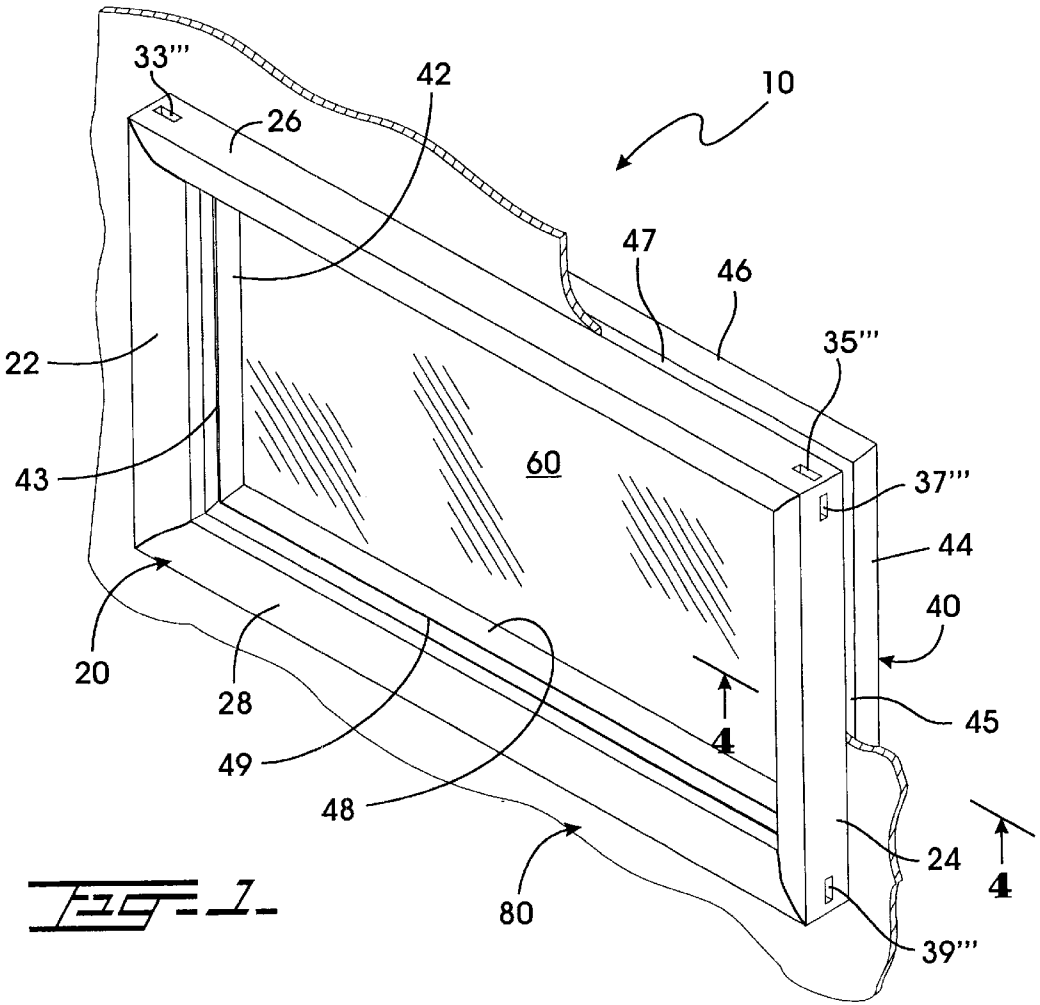
FIG. 1 represents an isometric view of one of the preferred embodiments for the window frame object of the present invention, mounted to a garage door panel (partially shown).

Referring now to the drawings, where the present invention is generally referred to with numeral 10, it can be observed that it basically includes outer and inner frame assemblies 20 and 40, respectively, that sandwich transparent member 60 and panel or skin 80 (such as steel) having an opening of predetermined dimensions, as shown in FIG. 1.

Figure 2:
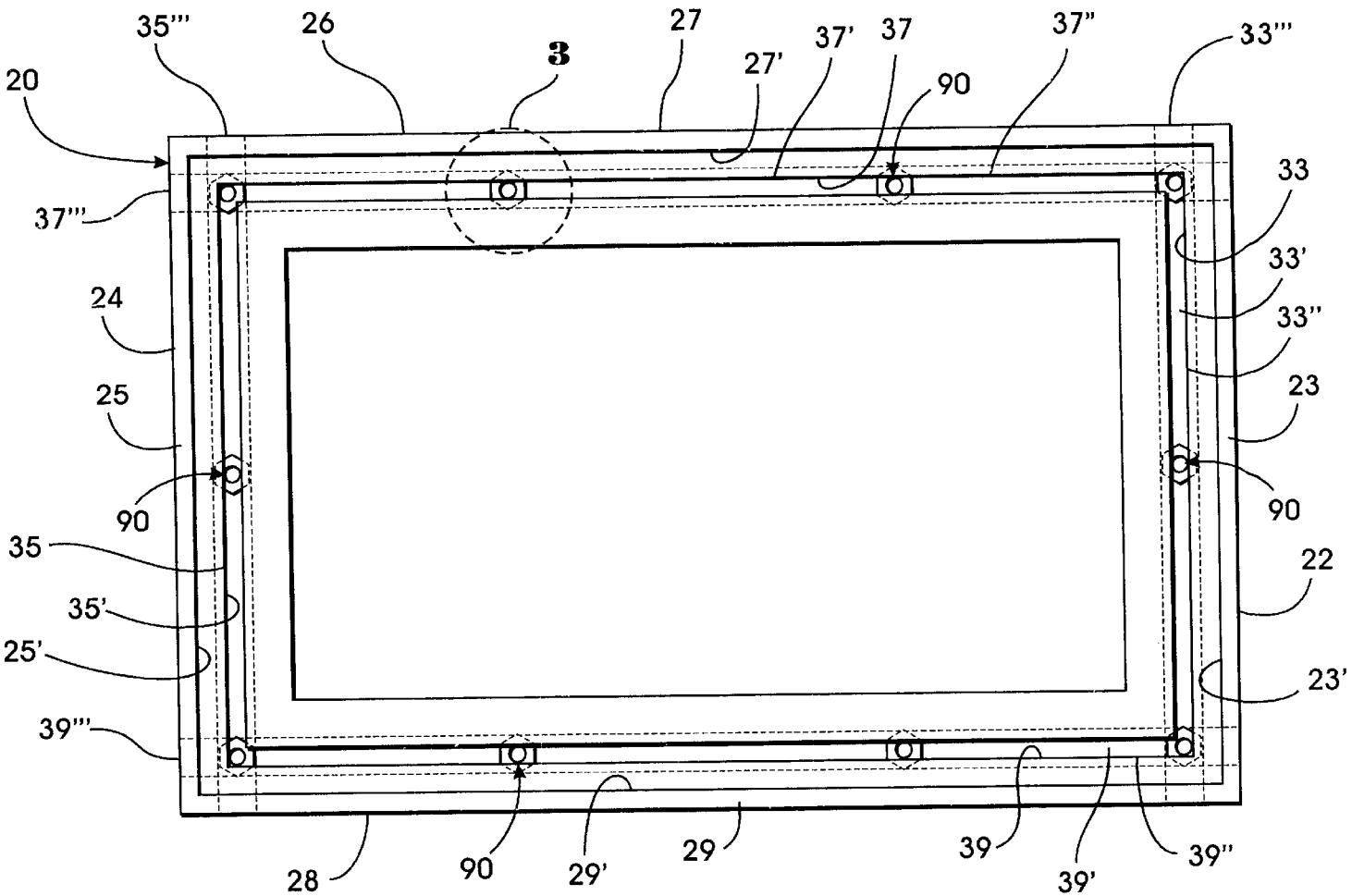
FIG. 2 shows a rear elevational view of the outer frame, for the embodiment represented in FIG. 1, showing the internal channels for slidably receiving nut members.
Figure 3:
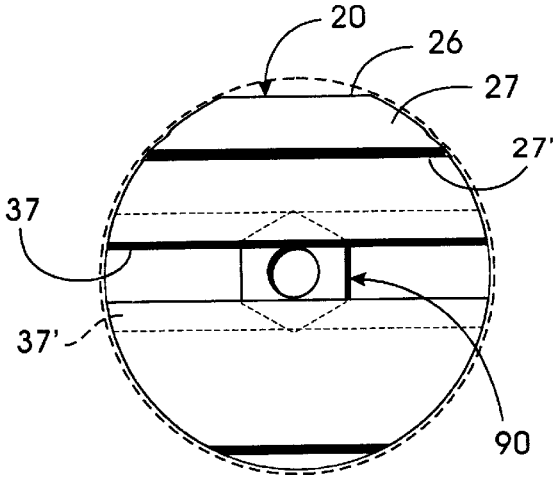
FIG. 3 illustrates an enlarged view taken from FIG. 2, showing a nut member slidably received within the channel.
Figure 4:
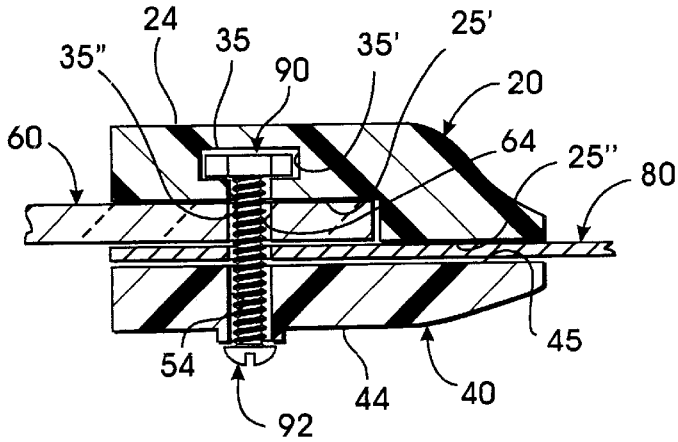
FIG. 4 is a cross-sectional view taken along line 4—4 in FIG. 1 showing the engagement of the bolt of fastening member with the nut member.

Outer frame assembly 20 includes elongated vertical frame assemblies 22 and 24 that are kept at a spaced apart and parallel relationship with respect to each other by perpendicularly mounted elongated horizontal members 26 and 28. Peripheral surfaces 23; 25; 27 and 29 of members 22; 24; 26 and 28, respectively, include longitudinal channels 33; 35; 37 and 39, respectively, as seen in FIG. 2. Channels 33; 35; 37 and 39 have substantially T-shape cross-sections. Channels 33; 35; 37 and 39 extend, in the preferred embodiment, along the entire length of members 22; 24; 26 and 28, respectively. But, it is also possible that these channels do not extend the entire length and extend only sufficiently to provide cooperative positions for the engagement of nut members 90. The innermost portion 33'; 35'; 37' and 39' of channels 33; 35; 37 and 39 is wider than neck portions 33"; 35"; 37" and 39", as best seen in FIG. 4. Innermost portions 33'; 35'; 37' and 39' slidably receive nut members 90, as best seen in FIG. 3. The user places nut member 90 in a cooperative position for fastening members 92 to go through neck portions 33"; 35"; 37" and 39" and engaging with nut member 90. This permits a user to secure outer member 20, inner frame assembly 40, transparent member 60 and panel 80.

Channels 33; 35; 37 and 39 include entry openings 33'"; 35'"; 37'" and 39" for receiving nut members 90. As shown in FIG. 4, in the preferred embodiment, peripheral surface 25 includes inner peripheral surface 25', which is a stepped cutout and outer peripheral surface 25". Surfaces 25' and 25" are in different planes. The step between them cooperatively provides for the necessary space to receive the edge of transparent panel 60. In this embodiment, transparent member 60 is sandwiched between inner peripheral surface 25', panel 80 and peripheral surface 45 of inner frame assembly 40.

Inner frame assembly 40 includes elongated vertical frame members 42 and 44 that are kept at a spaced apart and parallel relationship with respect to each other by perpendicularly mounted elongated horizontal members 46 and 48. Peripheral surfaces. 43; 45; 47 and 49 are defined in members 42; 44; 46 and 48, respectively. Frame members 42; 44; 46 and 48 include through openings 52; 54; 56 and 58, respectively. Also, transparent member 60 includes through openings 62; 64; 66 and 68 cooperatively disposed to coincide with through openings 52; 54; 56 and 58.

In the preferred embodiment, a user slides nut member 90 in a cooperative position to coincide with through openings 52 (or 54; 56 and 58). The bolts of fastening members 92 go through openings 52 (or 54; 56 and 58), through openings 62 (or 64; 66 and 68) and necks 33" (or 35"; 37" and 39"). Fastening members 92 secure outer member 20, inner frame assembly 40, transparent member 60 and panel 80.

Figure 5:
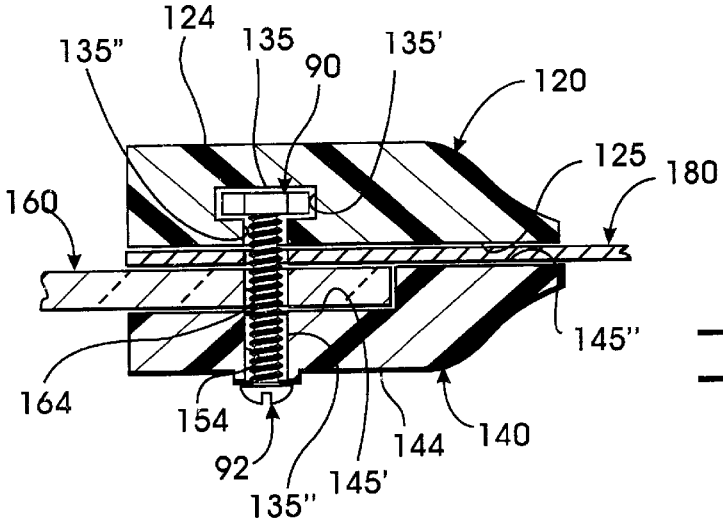
FIG. 5 is a cross-sectional view of an alternate embodiment for the present invention, taken in the same position than FIG. 4, wherein the transparent member is sandwiched between the panel and the inner frame assembly.

An alternate embodiment for the mounting mechanism is shown in FIG. 5. Here, inner peripheral surface 145', which is a peripheral stepped cutout of alternate inner frame assembly 140, extends at a spaced apart plane with respect to outer peripheral surface 145". The separation is cooperatively sufficient to receive the edge of transparent panel 160. In this embodiment, transparent panel 160 is sandwiched between surface 145' and panel 180, which in turn abuts with flat surface 125 of this alternate outer window frame 120. Frame member 124 includes longitudinally extending channels 135 with innermost portion 135' and neck portion 135".

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A window frame assembly for a closure with first inner and outer surfaces having an opening with a peripheral edge, comprising:

A) an outer frame assembly extending over said peripheral edge and mounted against said outer surface, said outer frame assembly including second inner and outer surfaces and an internal longitudinal channel through at least predetermined portions of said outer frame assembly and said channel including a longitudinal innermost portion and a narrower neck portion continuously extend to said second inner surface;

B) an inner frame assembly extending over the periphery of said opening and being mounted against said first inner surface, and including a third inner and outer surfaces, said third inner surface including a first plurality of through openings;

C) a transparent member having a peripheral edge with cooperative dimensions to cover said opening and being sandwiched by said inner and outer frame assemblies and said transparent member further including a plurality of second through openings the are cooperatively disposed to be in alignment relationship with said plurality of first through openings; and D) fastening means for keeping said transparent member, inner and outer frame assemblies mounted against each other.

2. The window frame assembly set forth in claim 1 wherein said second inner surface includes a longitudinal and peripheral stepped cutout for receiving the edge of said transparent member.

3. The window frame assembly set forth in claim 2 wherein said fastening means include at least one nut member slidably received within said innermost portion of the longitudinal channel and at least one bolt member passing through at least one of said first and second through openings and being engaged to said nut member thereby keeping said outer fame assembly, inner frame assembly, and transparent member securely mounted against said closure.

4. The window frame assembly set forth in claim 3 wherein said outer frame assembly includes at least one entry opening for receiving said nut members.

5. The window frame assembly set forth in claim 1 wherein said third inner surface includes a longitudinal and peripheral stepped cutout for receiving the edge of said transparent member and a predetermined portion adjacent to said edge.

6. The window frame assembly set forth in claim 4 wherein said fastening means include at least one nut member slidably received within said innermost portion of the longitudinal channel and at least one bolt member passing through at least one of said first and second through openings and being engaged to said nut member thereby keeping said outer fame assembly, inner frame assembly, and transparent member securely mounted against said closure.

* * * * *